US006082597A

United States Patent [19]

Beckett et al.

[11] Patent Number: 6,082,597

[45] Date of Patent: Jul. 4, 2000

[54] DISPENSER FOR VISCOUS MATERIAL

[75] Inventors: Clifford E. Beckett, Thatcham; Andrew C. Leech, Newbury, both of United Kingdom

[73] Assignee: P.C. Cox Limited, Newberry, United Kingdom

[21] Appl. No.: 09/252,286

[22] Filed: Feb. 18, 1999

[30] Foreign Application Priority Data

Feb. 18, 1998 [GB] United Kingdom ..... 9803418

[51] Int. Cl.[7] ..... B67D 5/42

[52] U.S. Cl. ..... 222/391; 222/327; 222/390; 222/326

[58] Field of Search ..... 222/391, 327, 222/390, 326

[56] References Cited

U.S. PATENT DOCUMENTS

| | | | |
|---|---|---|---|
| 2,561,825 | 7/1951 | Sherbondy | 222/327 |
| 2,572,206 | 10/1951 | Sherbondy | 222/327 |
| 2,602,571 | 7/1952 | Sherbondy | 222/391 |
| 3,595,448 | 7/1971 | Carlton | 222/327 |
| 3,997,085 | 12/1976 | Lindquist | 222/391 |
| 4,067,479 | 1/1978 | Moline . | |
| 4,865,229 | 9/1989 | Schneider et al. . | |

FOREIGN PATENT DOCUMENTS

| | | |
|---|---|---|
| 0 369 568 A1 | 5/1990 | European Pat. Off. . |
| 825409 | 12/1959 | United Kingdom . |
| 2281759A | 3/1995 | United Kingdom . |

*Primary Examiner*—Andres Kashnikow
*Assistant Examiner*—Dinh Q. Nguyen
*Attorney, Agent, or Firm*—Patterson & Keough, P.A.

[57] ABSTRACT

A dispenser for a single cartridge has a yoke pivotably mounted on a stock. The yoke has a square-section open end and a circular section closed end. One flat side on the square section end provide an abutment for defining the closed position of the yoke. The yoke has a similar flat surface engages the plate side of the yoke. The flat surface on the stock is easily formed in the manufacturing process.

12 Claims, 7 Drawing Sheets

DISPENSER FOR VISCOUS MATERIAL

This invention relates to a dispenser for a viscous material.

Dispensers for viscous materials come in many forms. A common arrangement is often referred to as a dispensing gun. It has a stock which supports a dispensing mechanism, a handle depending from the stock, a trigger mounted in the stock to actuate the dispensing mechanism, and a yoke for retaining a cartridge of viscous material. As part of the dispensing mechanism, a plunger is advanced by actuation of the trigger into the yoke to squeeze the viscous material out of the cartridge through an aperture.

Various ways have been proposed for arranging and retaining the cartridge in the yoke. In some proposals the yoke is an open frame or cradle into which the rigid cartridge is dropped to be aligned to receive the plunger. In others, the yoke is a full circular-section cylinder which is screwed on to the stock. By removing the cylinder, a bag or a rigid cartridge can be inserted within the cylinder. When the cylinder is screwed back onto the yoke, the cartridge is aligned with the plunger.

In some applications two materials have to be dispensed together. For this, a pair of rigid cartridges can be mounted together. The dispenser for such a double cartridge arrangement can have two plungers which act on the cartridge simultaneously to force the materials through a common outlet for mixing. In a more particular form, advantage has been taken of the necessarily laterally elongate yoke required to hold two cartridges side by side. The yoke is mounted by a swinging breach construction by which the cartridge can be swung into and out of alignment with the plunger. The yoke is biassed closed when a dispensing force is applied to the plunger because the axis of the breach movement is not aligned with the centre of force of the plunger. A surface on the elongate section yoke bears against a surface on the stock to keep the cartridge in position.

It will be appreciated that single cartridges for known dispensers are invariably circular in section if they are rigid. In advancing a plunger against the material, obvious mechanical benefits apply to a circular section cartridge in terms of stress distribution and sealing a plug in the cartridge so that the material does not leak backwards past the plunger.

The cost of manufacturing a dispensing gun is influenced by the number of manufacturing steps required to form the components from, e.g. sheet metal. The cross-section of yoke for single cartridge dispensers has always conformed to the circular cross-section of the cartridge. Because of this, the swinging construction of dispenser has been discounted for single cartridges. If the circular section yoke swings about a pivot, an arcuate surface on the end of the yoke has to mate with a similarly shaped surface on the stock to take the load. If the arcuate side of the yoke engaged a non-conforming surface on the stock there would be a concentration in force which might distort the yoke and the cartridge inside. The formation of the requisite shaped surface on the stock takes many manufacturing steps. Thus, it has always been considered impracticable to manufacture cost-effectively a stock from sheet metal for a breach construction dispenser that mates with a yoke by anything other than a threaded engagement. However, mounting a yoke to a stock by means of a screw thread is relatively time-consuming and labourious in comparison with shifting the yoke into an out of alignment with the plunger by a single movement.

It is an object of the present invention to provide a breach loadable single cartridge dispenser for a viscous material that requires less manipulation than the prior art devices which use threaded engagements between the stock and yoke.

According to the present invention there is provided a dispenser gun for a single cartridge of viscous material, comprising:

a plunger;

an actuating mechanism for advancing the plunger, a stock on which the actuating mechanism is mounted; and a yoke for holding the single cartridge in an operable relationship with the plunger for discharging the material as the plunger advances, characterised in that:

the yoke is swingable about an axis between a closed position aligned with the plunger in which the cartridge is in the said operable relationship and an open position in which a first end of the yoke is open to receive a cartridge, the yoke having at least one side wall with a substantially flat surface toward the first end adjacent the stock, which flat surface engages a substantially flat surface of the stock when the yoke is in the said closed position.

By forming the single cartridge yoke with a flat surface, e.g. a flat side wall, which engages a flat surface of the stock, the invention runs counter to the prior art and enables a cost-effective single cartridge dispenser that is easily manipulated to be produced. The yoke is mounted to the stock by means of a pivot so that only a single movement is required to move the yoke to load and unload the single cartridge. The force of the yoke bearing on the flat surface of the stock is distributed evenly across a surface that is cost-effective to form.

Preferably, the yoke is swingable about an axis parallel to the planar surface between the closed position in which the cartridge is arranged in the operable relationship to the plunger, and the open position in which the cartridge is insertable or removable from the yoke, movement of the yoke to the loaded position causing engagement of the planar surface with the flat surface on the stock.

The planar surface is most conveniently also a continuous flat surface. However, it could be constituted by a series of projections defining a flat surface across them. Preferably, the yoke has a substantially rectangular cross-section at at least the one end adjacent the stock, the rectangular cross-section including a flat side wall for engagement with the flat surface on the stock.

In the invention the manufacturing problems associated with single cartridge dispensers having only a single movement between loaded and open positions are overcome by the provision of a flat engaging surfaces on the yoke and the stock. The known circular-section yokes require a relatively complex manufacturing process to form a suitable surface in the stock to be engaged by the yoke in the loaded position and, thereby, spread the load.

The present invention can be put into practice in various ways, some of which will now be described by way of example with reference to the accompanying drawings in which.

Figure 1:
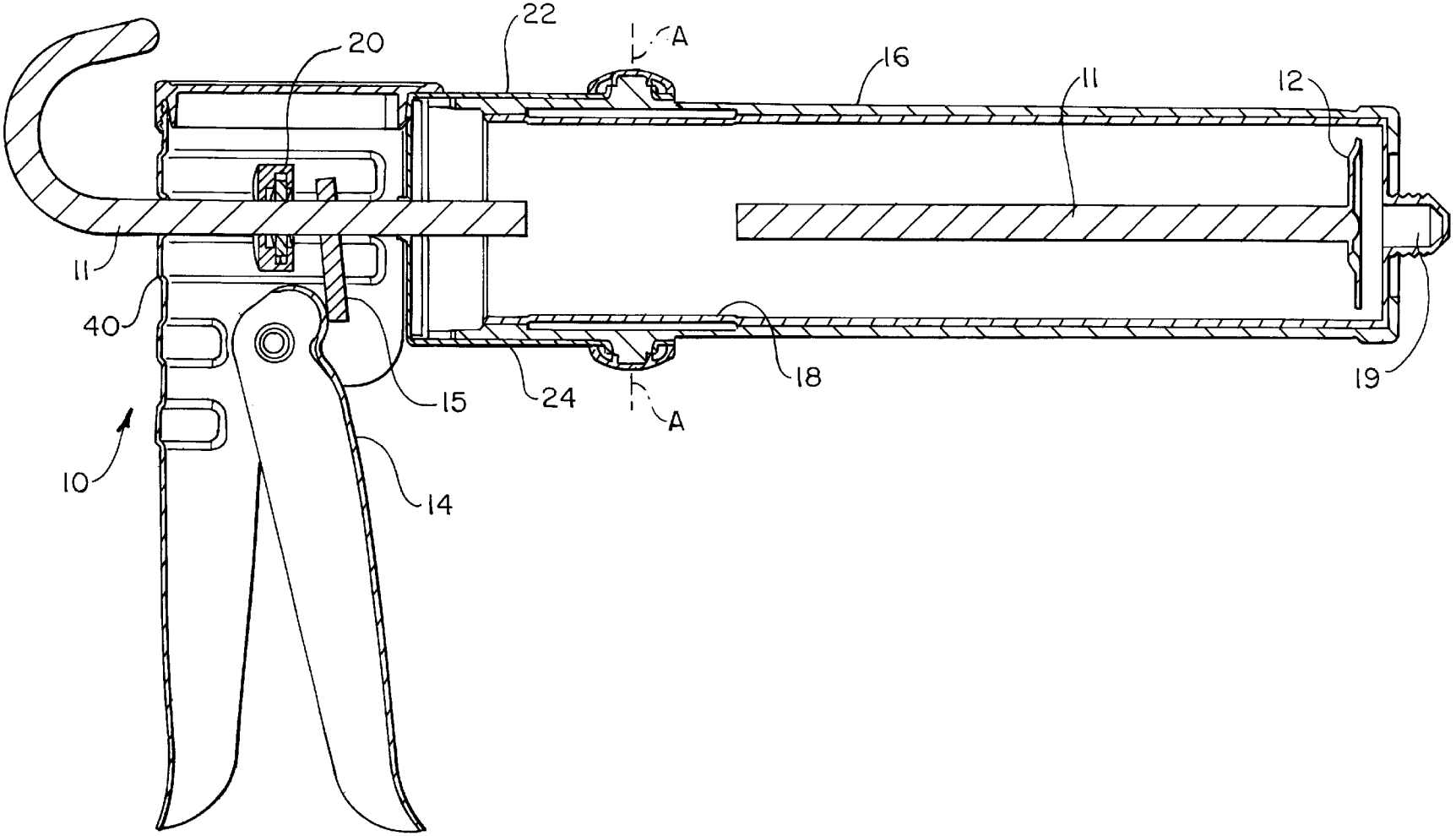
FIG. 1 is a cross-section of a dispenser according to the invention.

Referring to FIGS. 1 to 4, a single cartridge dispensing gun comprises a stock 10 formed from sheet steel, and a rod 11 and plunger 12 mounted for sliding axial movement through the stock 10. A trigger 14 is pivotably mounted in the stock 10 to advance the rod, and hence the plunger 12, by engaging a catch plate 15. A yoke 16 is mounted to swing about an axis A for loading and unloading a cartridge 18 of the viscous material. The stock 10 also supports a release plate 20 that rides on the rod 11 as the rod is advanced.

It will be understood that squeezing the trigger 14 carries the rod and plunger forward by engagement of the catch plate 15. This advances the plunger 12 into engagement with a movable sealing disc (not shown) within the circular cross-section cartridge to push the viscous material before it. As a result, the viscous material is dispensed through an aperture 19 in the end of the cartridge 18 remote from the stock. The rod is prevented from retreating by the release plate engaging the rod until the release plate 20 is actuated to allow the rod to retreat. The mechanism for advancing the rod 11 and the release plate 20 are known in the art and will not be described in further detail here.

The front of the stock 10 is formed with upper and lower members 22/24 that extend forwardly above and below the yoke 16. The yoke is pivotably mounted between the members 22/24 such that it is swingable about the axis A that is perpendicular to the axis of the rod 11.

Figure 5:
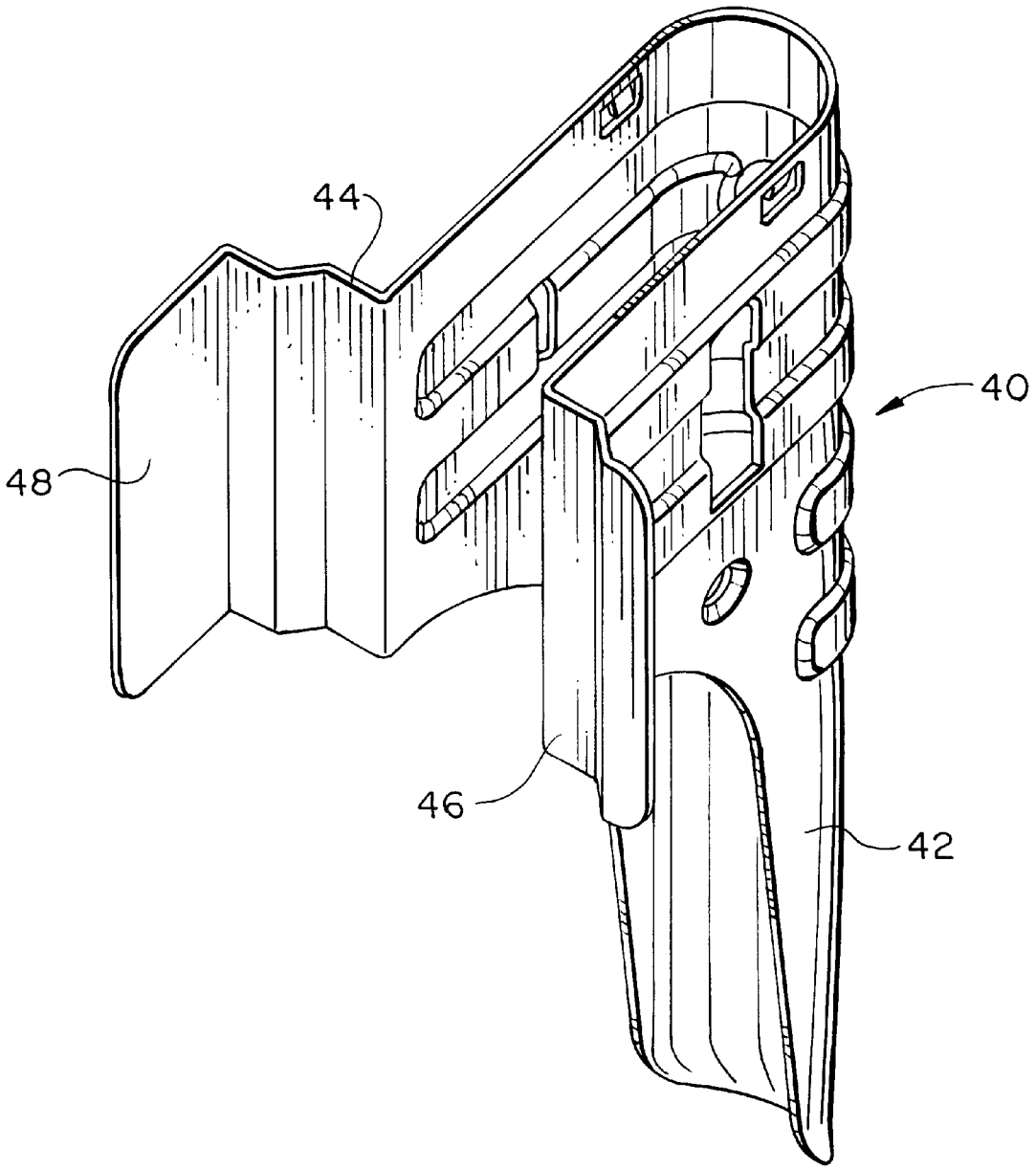
FIG. 5 is a perspective view of a stock part of the dispenser of FIG. 1.

Referring to FIG. 5, the main body 40 of the stock 10 is formed from a pressed sheet of steel which is folded round generally in a U-shape also to define a handle 42. The arms of the U-shape are extended to define outwardly protruding flanges 44 and 46. On one side, the flange 44 also protrudes further forwardly in the direction of the arm to form a flat upright side member 48. A flat outer side surface 50 on the adjacent side of the yoke engages the side member 48 in the closed position. The side member 48 acts as an abutment to movement of the yoke past the closed position.

Figure 4:
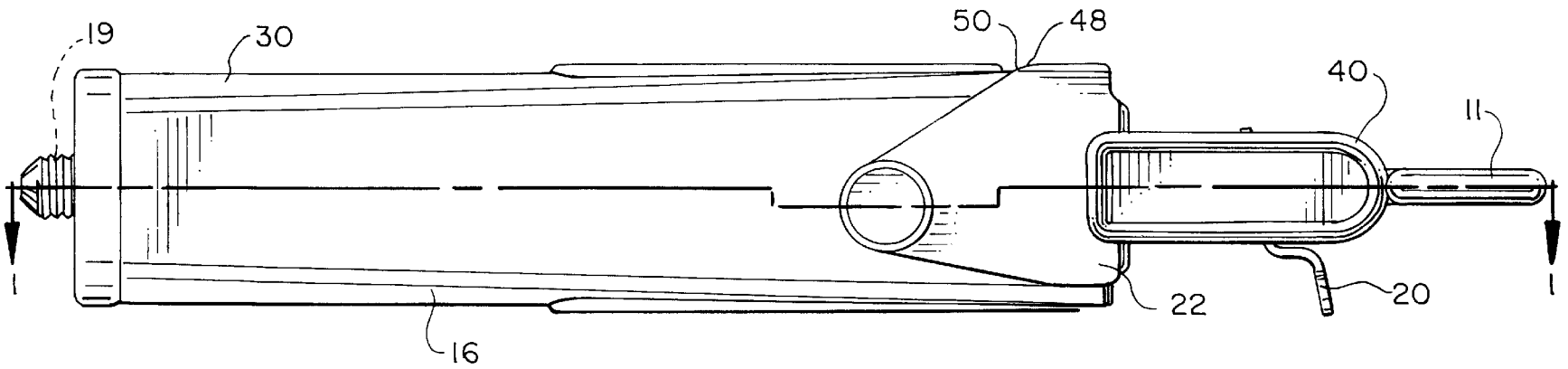
FIG. 4 is a plan view of the dispenser of FIG. 1.

As will be seen in FIG. 4, the axis A is offset with respect to the common centre line of the yoke 16, the rod 11 and the plunger 12. The offset of the axis A dictates that the force exerted on the plunger is unequal on either side of the axis. It will be apparent that more force is applied to one side of the yoke containing the major portion of the cartridge, than the other. In this way the yoke is biassed to the loaded position when an actuating force is applied to the plunger 12. In this position the side surface 50 bears against the member 48. It will be seen that the side surface 50 is one face of the substantially square-section end of the yoke and, thus, provides a naturally flat surface to engage the flat side member 48.

Figure 6:
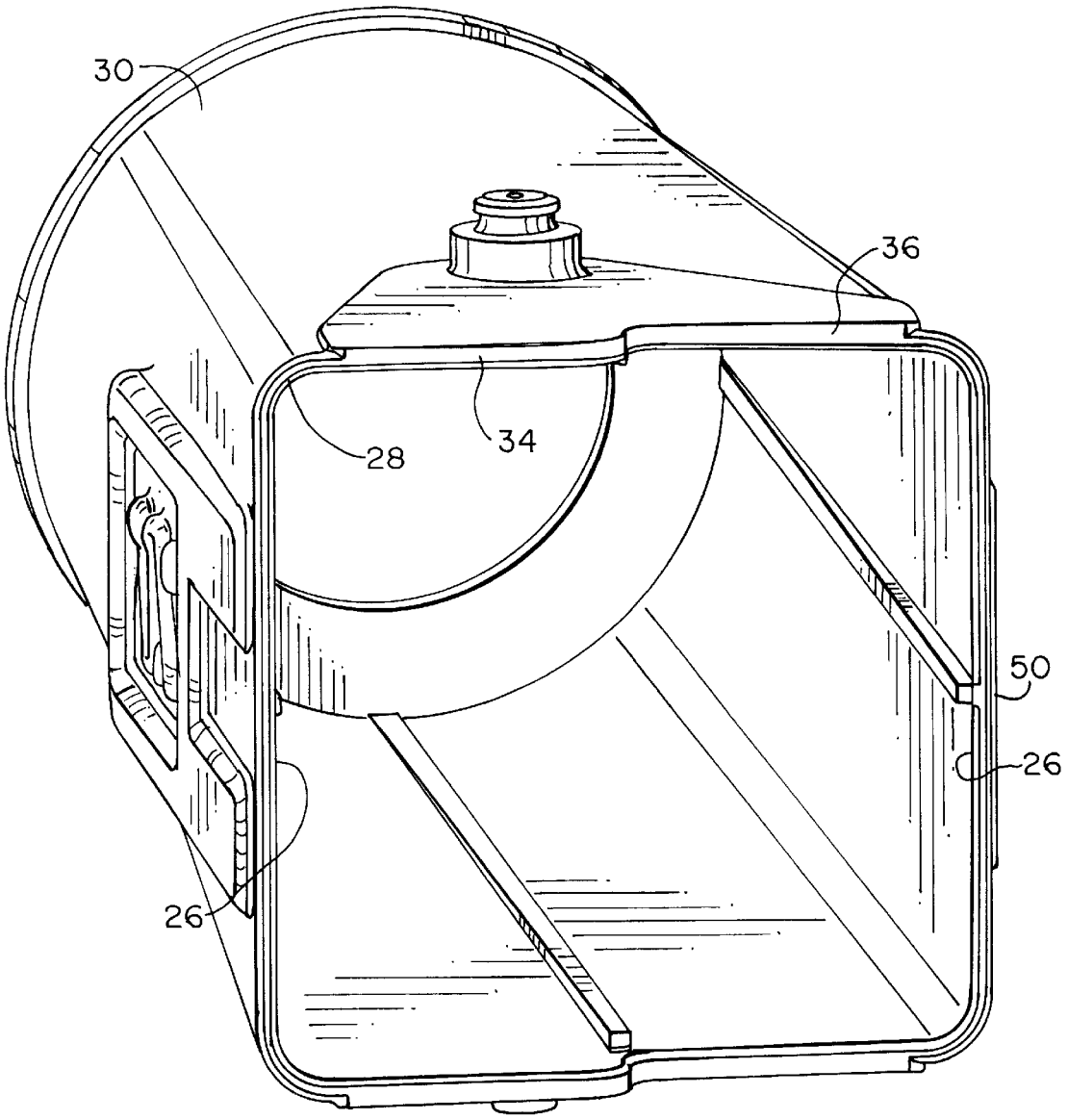
FIG. 6 is a rear end perspective view of the yoke of FIG. 1.
Figure 7:
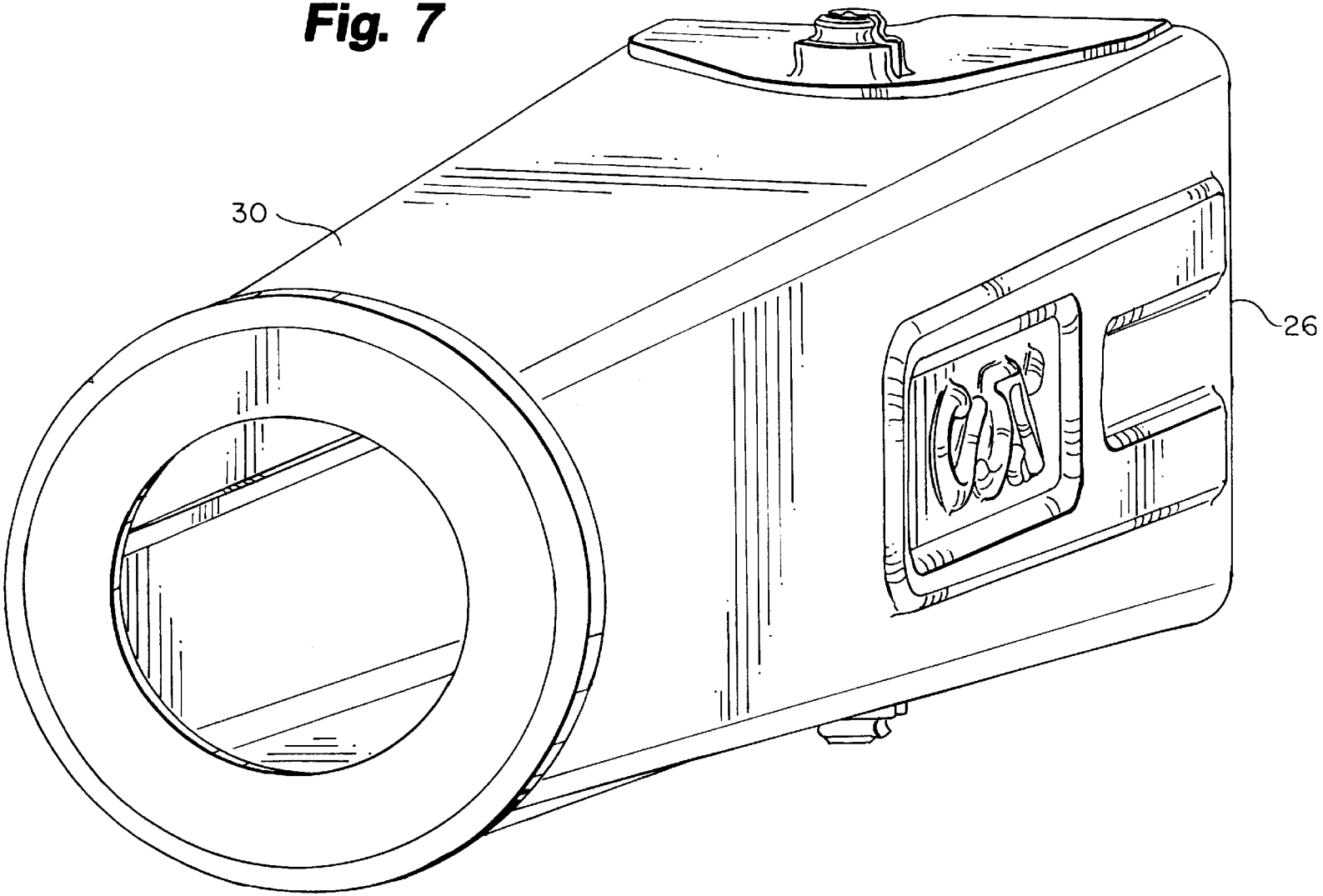
FIG. 7 is a front end perspective view of the yoke of FIG. 1.

The flat faces of the square cross-section end of the yoke merge smoothly with a fully circular cross-section part 30 of the yoke at the opposite end. This is illustrated particularly in FIGS. 6 and 7. The inner diameter of the circular cross-section part 30 of the yoke 10 is dimensioned to accommodate a circular cross-section cartridge. Similarly, the space across the flats 26 between radiused comers 28 of the square cross-section part of the yoke is also arranged to support the cartridge at four points defined by longitudinally extending ribs 32 formed on the inside surface of the yoke.

Referring particularly to FIG. 4, it will be seen that the square cross-section end of the yoke 10 has a first portion 34 defining a flat end face and a recessed portion 36. The recessed portion 36 provides clearance as the yoke is swung between the loaded and open positions.

Figure 2:
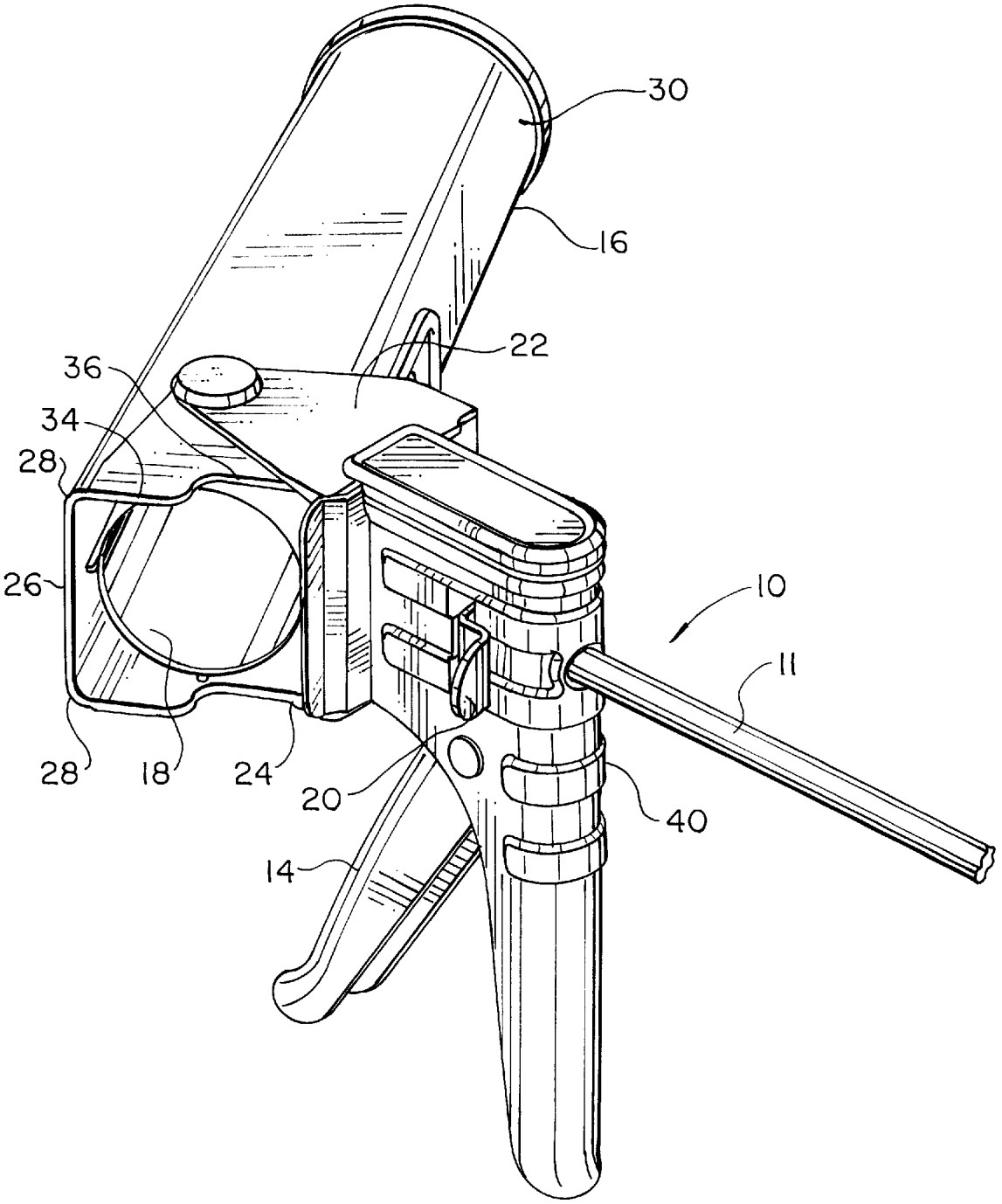
FIG. 2 is a perspective view from one side of the dispenser of FIG. 1.
Figure 3:
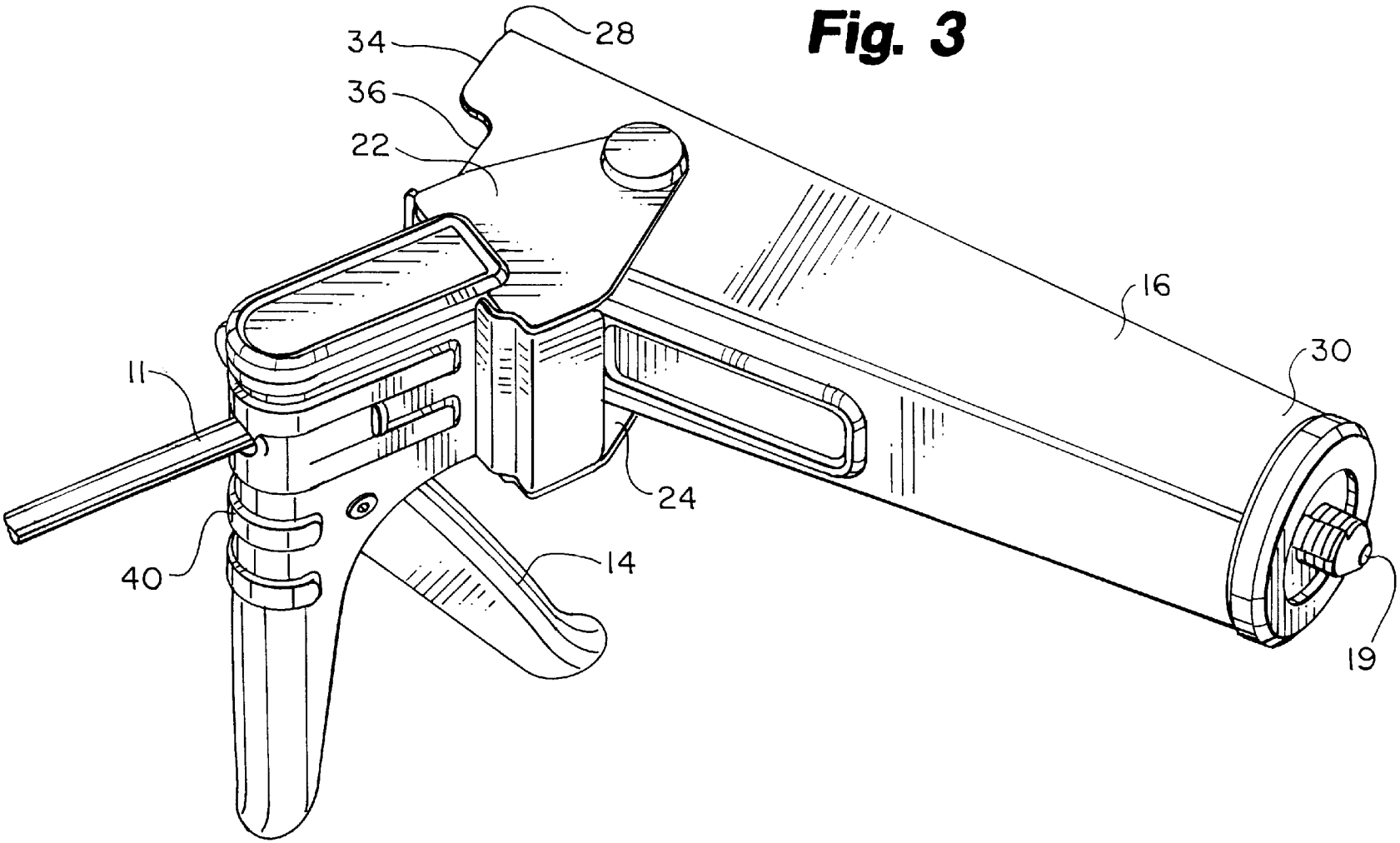
FIG. 3 is a perspective view from the other side of the dispenser of FIG. 1.

The yoke 10 is rotatable about the axis A into the loaded position (and while the plunger is retreated fully within the stock) by rotating it anti-clockwise (as depicted in FIGS. 1 and 2. The force exerted by the plunger 12 tends to urge the yoke in the same direction due to the relative displacement between the axes of the plunger and the yoke. This tends to keep the yoke closed in the loaded position and, thus, keeps the cartridge aligned with the plunger 12.

The yoke is moved to the open position by retreating the rod 11 such that the plunger 12 is clear of the yoke. It is then possible to swing the yoke about the axis A clockwise so that the square cross-section end of the yoke is exposed to retrieve a spent cartridge and/or to load a cartridge into the yoke. Thereafter, the yoke can be swung anticlockwise such that the flat surface 50 on the yoke engages the side member 48 on the stock to define the closed position. It is then possible to advance the rod such that the plunger engages the movable plug seal in the end of the circular cartridge to dispense the viscous material.

In the particular embodiment, the invention relies upon the significant benefits that are derived from forming the yoke with the unusual square cross-section end nearest the stock such that the flat surface afforded by the square cross-section can be exploited to engage a more easily manufactured flat surface on the stock. To fabricate such a construction using a conventional, consistently circular cross-section yoke would require relatively more complex manufacturing operations using sheet metal.

What is claimed is:

1. A dispenser for a single cartridge of viscous material, comprising:

a plunger;

an actuating mechanism for advancing the plunger;

a stock on which the actuating mechanism is mounted; and a yoke movable between a closed position, for holding the single cartridge in an operable relationship with the plunger for discharging the material as the plunger advances, and an open position in which a first end of the yoke is open to receive the cartridge;

wherein the yoke is swingable about an axis between the closed and open positions, the yoke defining a flat surface toward the first end adjacent the stock, which flat surface engages a flat surface on the stock when the yoke is in the closed position.

2. A dispenser as claimed in claim 1 in which the yoke has a substantially rectangular cross-section at at least the first end adjacent the stock, the cross-section including the said flat surface for engagement with the flat surface of the stock.

3. A dispenser as claimed in claim 1 in which the yoke has a circular cross-section at the end remote from the stock.

4. A dispenser as claimed in claim 2 in which the yoke has a circular cross-section at the end remote from the stock.

5. A dispenser as claimed in claim 2 in which the yoke defines longitudinal cartridge supporting ribs.

6. A dispenser as claimed in claim 3 in which the yoke defines longitudinal cartridge supporting ribs.

7. A dispenser as claimed in claim 1 in which the axis about which the yoke is arranged to swing between the closed and open positions is parallel to the flat surface on the stock.

8. A dispenser as claimed in claim 2 in which the axis about which the yoke is arranged to swing between the closed and open positions is parallel to the flat surface on the stock.

9. A dispenser as claimed in claim 1 in which the axis of the swing of the yoke is offset with respect to the center of force of the plunger such that the yoke is biased to the closed position when a force is exerted on a cartridge by the plunger.

10. A dispenser as claimed in claim 1 in which the stock is formed of sheet metal and the flat surface on the stock is an extension of one side of the stock formed from the sheet metal.

11. A dispenser as claimed in claim 1 in which the stock is formed of steel.

12. A dispenser as claimed in claim 1 in which the center of force of the plunger is not coincident with the axis about which the yoke is swingable, such that a dispensing force applied to the plunger urges the yoke to the closed position.

* * * * *